United States Patent [19]

Tanaka et al.

[11] 4,337,384

[45] Jun. 29, 1982

[54] COOKING APPLIANCE OF THE HOT AIR CIRCULATING TYPE

[75] Inventors: Junzo Tanaka, Fujiidera; Toshio Kai, Nara, both of Japan

[73] Assignee: Matsushita Electric Industrial Co., Ltd., Kadoma, Japan

[21] Appl. No.: 173,905

[22] Filed: Jul. 30, 1980

[30] Foreign Application Priority Data

| | | | |
|---|---|---|---|
| Aug. 1, 1979 | [JP] | Japan | 54-98937 |
| Aug. 2, 1979 | [JP] | Japan | 54-99045 |
| Aug. 2, 1979 | [JP] | Japan | 54-99046 |
| Sep. 12, 1979 | [JP] | Japan | 54-116981 |

[51] Int. Cl.[3] ..... H05B 6/68

[52] U.S. Cl. ..... 219/10.55 B; 219/10.55 R

[58] Field of Search ..... 219/10.55 R, 10.55 B, 219/10.55 F, 10.55 M, 10.55 A

[56] References Cited

U.S. PATENT DOCUMENTS

| | | | |
|---|---|---|---|
| 3,428,772 | 2/1969 | Wallenfels | 219/10.55 F |
| 3,514,576 | 5/1970 | Hilton et al. | 219/400 |
| 3,854,219 | 12/1974 | Staats | 219/10.55 R |
| 3,884,213 | 5/1975 | Smith | 219/10.55 R |
| 4,132,878 | 1/1979 | Tachikawa et al. | 219/10.55 B |
| 4,225,767 | 9/1980 | Hatanaka et al. | 219/10.55 F |

FOREIGN PATENT DOCUMENTS

| | | | |
|---|---|---|---|
| 572709 | 2/1976 | Switzerland | 219/10.55 R |

*Primary Examiner*—Arthur T. Grimley

*Attorney, Agent, or Firm*—Wenderoth, Lind & Ponack

[57] ABSTRACT

The invention is related to improvements in a cooking appliance equipped with both a microwave heating means and a hot air circulation heating means. By controlling the rotational speed of an air circulating fan or the power of heater means according to the kind of food to be cooked, the cooking time is shortened and the quality of cooked food is improved. The hot air discharging section of such an oven includes a perforated plate so as to prevent leakage of microwaves from the heating chamber, and an air baffle means is provided strategically in the hot air discharging section to ensure a uniform distribution of temperature within the heating chamber. The invention also includes an improved relative position of the air inlets, a double-deck tray and the air baffle means which functions to prevent a substantive dehydration of food which is a drawback of a conventional hot air circulation heating system.

10 Claims, 11 Drawing Figures

COOKING APPLIANCE OF THE HOT AIR CIRCULATING TYPE

BACKGROUND OF THE INVENTION

1. Field of the Invention

This invention relates to a cooking appliance having the dual function of hot air circulation heating and microwave energy dielectric heating. More particularly, this invention relates to a cooking appliance comprising a heating chamber and a compartment adjacent to said heating chamber, said compartment accommodating a heater means for elevating the atmospheric temperature within said heating chamber and a fan means for circulating the air through said heating chamber and compartment.

2. Description of the Prior Art

The cooking appliances of the hot air circulating type which have so far been available on the market are not equipped with means for varying the rotational speed of a air-circulating fan but rather the fan speed is substantially constant. Therefore, in the appliances designed mainly for making confectionary items, the usual arrangement calls for the lowest possible fan speed in order to reduce the velocity of hot air flow so as not to cause the food to dry. As a consequence, when a foodstuff such as a whole poultry or its thigh or the like is to be cooked, the low air velocity means prolongs cooking and it takes a fairly long time to brown the surface of the food. And a substantial portion of the broth seeps out thereby impairing the flavor of food.

On the other hand, a cooking appliance designed mainly for the cooking of meat has the disadvantage that when it is used for making confectonary items, the air velocity is so high that the surface of food will dry.

Furthermore, in the prior art cooking appliances, the path of circulating hot air comprises several comparatively large openings bored through the wall of a heating chamber, and when a microwave heating means is additionally incorporated in such an appliance, choke structures must be provided near the drive shaft of the circulating fan, the heater connection, etc., which entails an additional cost of manufacture. If the hot air is circulated through a multiplicity of small perforations, the air flow encounters a markedly increased resistance and, therefore, the amount of hot air introduced into the heating chamber is reduced, with the result that, notwithstanding a substantial increase of temperature within the compartment housing the heater means, the temperature in the heating chamber does not increase as might be expected, thus providing only a reduced thermal efficiency.

Moreover, in the prior art cooking appliance of hot air circulating type, the portion of the food located within vicinity of the energy feeding port is directly exposed to hot air flow and is heated intensively to brown the food but the portion of the food located away from this vicinity is exposed only to a reduced flow of hot air and tends to be undercooked or only inadequately browned. Therefore, the velocity of hot air had to be increased in order to avoid such an uneven cooking of food. However, the increased air velocity means that the hot air bombards the food with an additional force, which, in turn, means that the surface of food is subject to a more vigorous evaporation of water and becomes crusted, with the flavor of the food being also adversely affected.

OBJECTS OF THE INVENTION

It is a primary object of this invention to provide a cooking appliance of hot air circulating type with the provision of a control means which enables one to change the rotational speed of the air circulating fan and the power of heater means according to the kind of food to be cooked and in such a manner that a reduced air velocity will be provided for the making of cakes or other foods which tend to acquire dried surfaces and that an increased air velocity and, hence, a shorter cooking time will be assured for meat and fish which are less susceptible surface drying; i.e. a cooking appliance which, when used for the cooking of meat and fish, quick browns the surface of food to thereby minimize the loss of gravy from the food and thereby to ensures the production of cooked foods rich in flavor and nutritive value.

It is another object of this invention to provide a cooking appliance with a multiplicity of perforations through a partitioning wall between a heating chamber and a compartment housing an air circulating fan to thereby form inlets and outlets for hot air and further to provide air baffles disposed in appropriate positions in said compartment so that the distribution of heat in the heating chamber may be controlled and the leakage of microwaves from the heating chamber prevented.

It is another yet object of this invention to provide a cooking appliance such that an air baffle disposed at the hot air inlet is a ceramic insulator or the like which serves also as a supporting member for the heater means, whereby safety is ensured even when a sheath heater, which will suffer a decrease of insulation at high temperature, is employed and a better contact is ensured between the heater means and baffle, so that the efficiency of heat exchange between the heater and the circulating air will be improved and the manufacturing cost of the appliance reduced.

It is still another object of this invention to provide a cooking appliance such that the air baffles are disposed in positions respectively corresponding to the undersides of trays within the heating chamber at the hot air inlet so that the hot air will blow out along the bottoms of the trays in such a manner that the velocity of hot air impinging the food on the top of each tray is attenuated and hot air impinging the bottom of the upper deck of the tray structure is relatively increased to thereby minimize the dehydration of the surface of food and homogenize the tray temperature, so that the food will be cooked more evenly.

It is still another object of this invention to provide a cooking appliance incorporating a double-deck tray disposed in the heating chamber, with the center of the inlets of the air circulating fan being disposed at substantially the same elevation as the bottom surface of the upper tray so that the hot air flow will impinge with a greater force the bottom surface of the same tray and with a reduced force the food placed on the tray so as to mitigate the drying of food and ensure a uniform tray temperature.

BRIEF DESCRIPTION OF THE DRAWINGS

The above and other objects and advantages of this invention will become apparent as the following detailed description of the invention will be read in conjunction with the accompanying drawings, in which.

DETAILED DESCRIPTION OF THE INVENTION

Figure 1:
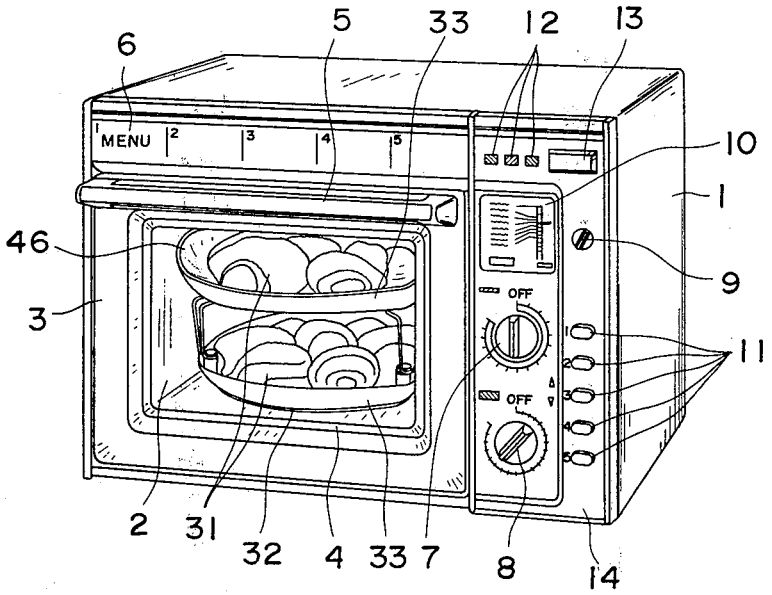
FIG. 1 is a perspective exterior view showing a cooking appliance of hot air circulating type as a preferred embodiment of this invention.

In FIG. 1 there is shown a cooking appliance of the hot air circulating type which comprises an outer casing (1) defining a heating chamber (2), one side of which is provided with a door means (3) for the opening and closing thereof.

The door (3) is provided with a screen (4) for ensuring a clear view of the inside of the heating chamber (2), and a handle (5) for the ease of opening and closing the door.

On the frontal side of said casing (1) and above the door (3) there is provided a display panel (6). There is also provided, alongside the door (3), an operation panel (14) carrying as timer knobs (7, 8), a cooking pattern select switch button (11), an indicating lamp (12), a cooking switch button (13), etc.

Figure 2:
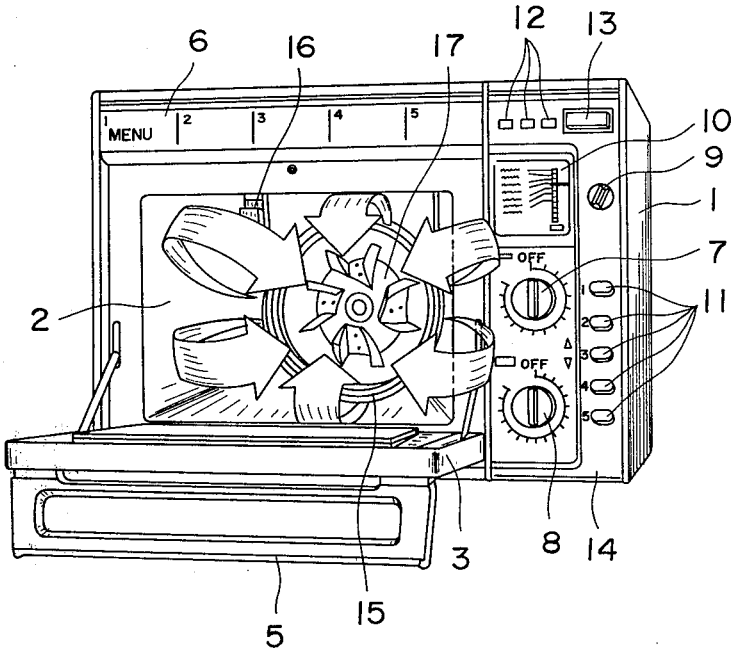
FIG. 2 is a perspective view showing the cooking appliance shown in FIG. 1 with the partitioning wall between a heating chamber and an adjacent compartment removed and the door opened.

Referring now, to FIG. 2, a heater means (15) is secured to the rear side of the heating chamber (2) by means of insulator (16) in such a manner that said heater means (15) encircles an air circulating fan (17). The air heated by said heater means (15) is circulated by the fan (17) through the heating chamber (2) as indicated by the arrows and the desired cooking takes place as the atmospheric temperature within the heating chamber (2) is thereby elevated.

Figure 3:
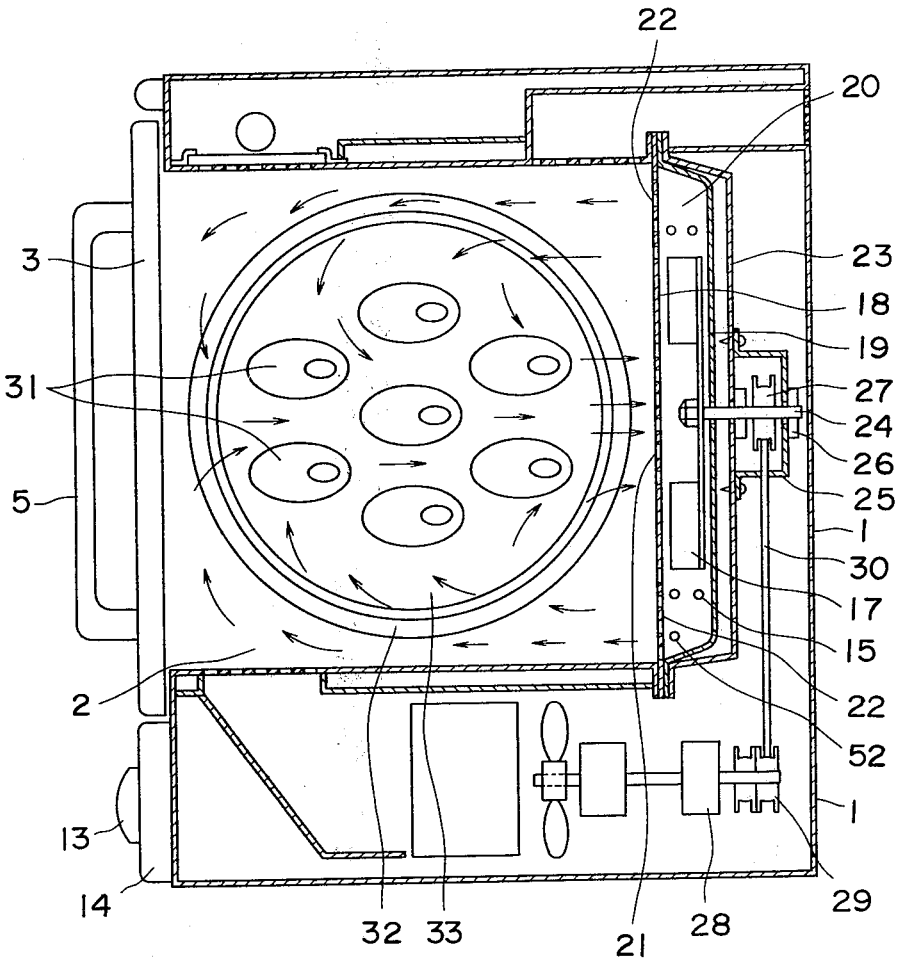
FIG. 3 is a transverse section view of the cooking appliance shown in FIG. 1.

Referring, now, to FIG. 3, the above-mentioned fan (17) is disposed in a compartment (20) defined by a partitioning wall (18), serving as said rear wall of heating chamber (2), and a deep-drawn plate (19), formed by deep-drawing a metal plate and located behind the heating chamber (2).

The above-mentioned heater (15) is located in the corresponding position around the fan (17).

The circulation of the air heated by heater means (15) is accomplished by drawing air through inlet perforations (21) in the central area of the partitioning wall (18) as indicated by the arrows and discharging the hot air from the compartment (20) into the heating chamber (2) through outlet perforations (22) provided in the peripheral area of the partitioning wall (18).

The above-mentioned fan (17) is driven by a fan shaft (24) extending through said deep-drawn plate (19) and a heat insulation plate (23) disposed behind plate (19).

The fan shaft (24) is supported by bearing means (26) secured to a bearing plate member (25) which, in turn, is secured to said heat insulation plate (23).

Mounted on said fan shaft (24) is a pulley (27), and the fan (17) is driven by a belt (30) positioned around said pulley (27) and a pulley (29) connected to an electric motor (28) which is described hereinafter.

A food (31) which is be heated in the heating chamber (2) is heated and cooked as it is rotated along with a tray (33) which is set on a turntable (32).

Figure 4:
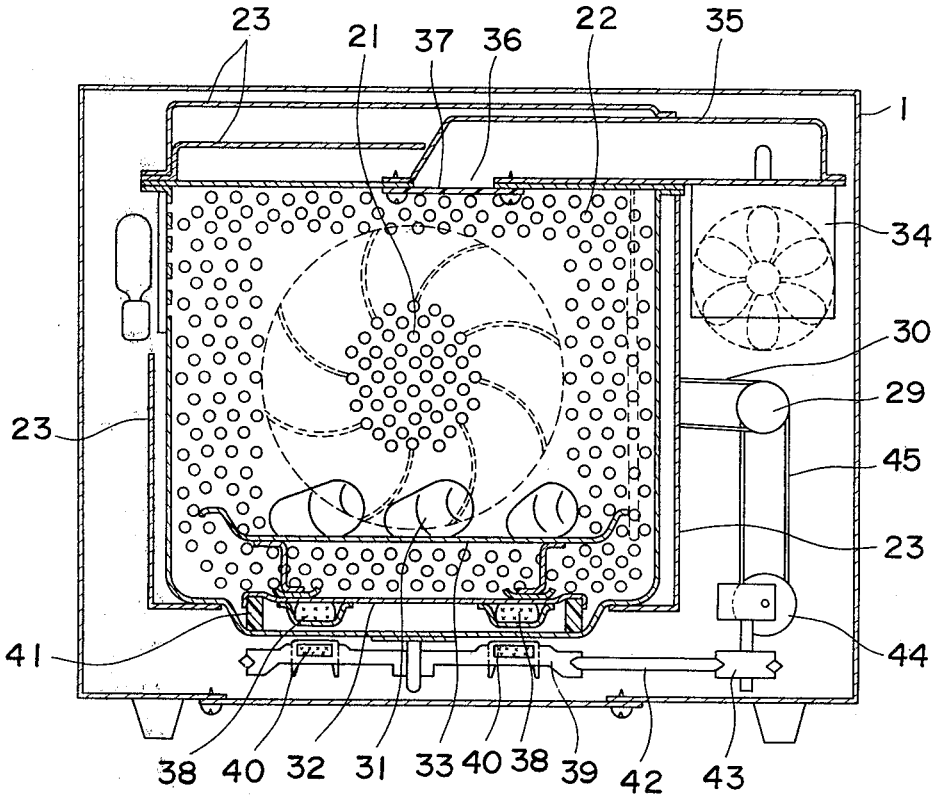
FIG. 4 is a longitudinal section view of the cooking appliance shown in FIG. 1.
Figure 5:
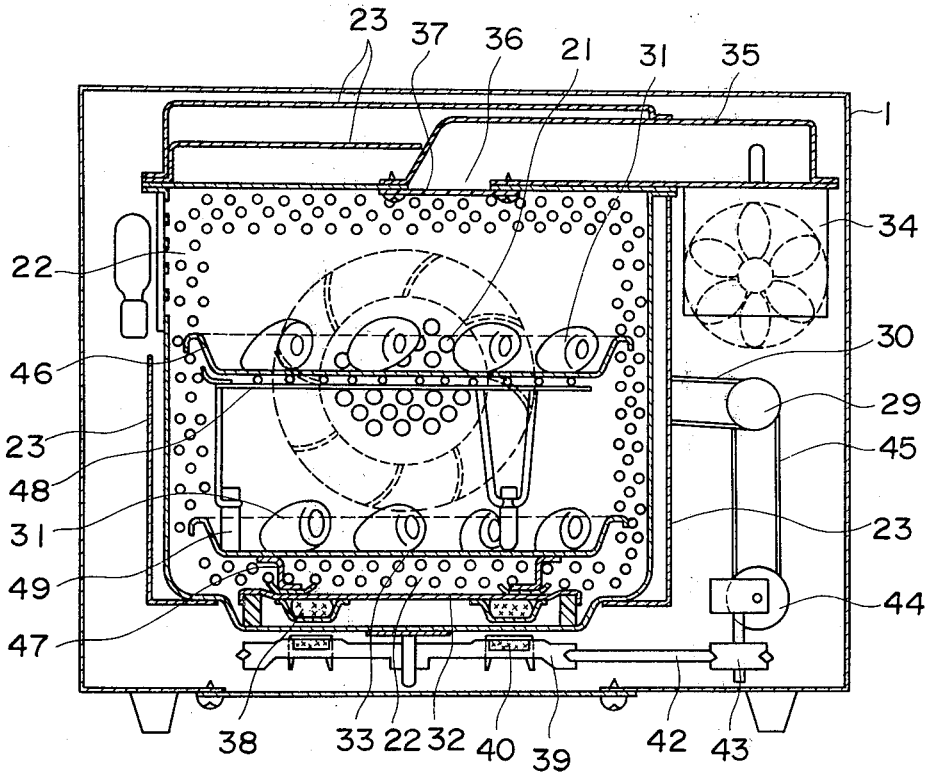
FIG. 5 is a longitudinal section view of the cooking appliance shown in FIG. 1 in which a double-deck tray structure has been accommodated.
Figure 6:
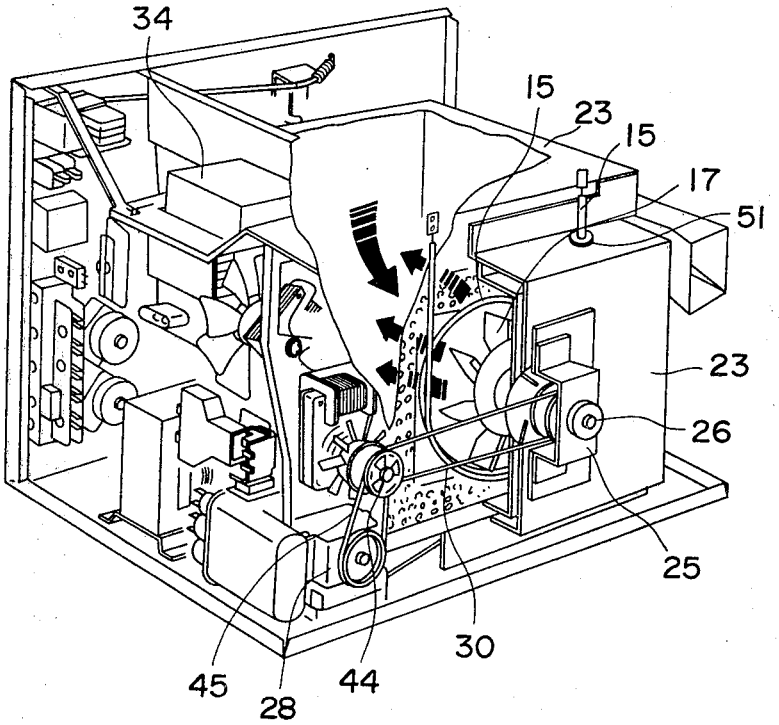
FIG. 6 is a perspective rear view of the cooking appliance shown in FIG. 1 with the outer casing members removed.

The disposition of food (31) on the tray can be seen from FIGS. 4 and 5.

Referring to FIG. 4, there is shown an energy feeding port (36) of a waveguide (35) for the propagation of a microwave energy from a magnetron which is a source of microwave energy and, thus, a second heat source. Said feeding port (36) is disposed in the center of a top wall of said heating chamber (2). The energy feeding port (36) is covered with a cover means (37) made of a dielectric material so as to preclude entry of crums, water vapor, etc. into the waveguide (35).

The wall structure of the heating chamber (2) is externally covered with a heat-insulating plate member (23) which prevents dissipation or loss of heat through the heating chamber wall in the course of cooking by hot circulating flow of air.

The turntable (32) rotatably mounted on the bottom wall of the heating chamber (2) is of the magnet-drive type, and a magnet (38) is fitted to the underside of the turntable (32). Therefore, by the rotation of a pulley (39), externally mounted on the bottom wall of the heating chamber, a magnet (40) fitted to the pulley (39) is also driven to establish a magnetic couple between magnets (40) and (38), and to thereby rotate the turntable (32), as it is supported by a roller (41).

The torque of a motor (28) is transmitted to the pulley (39) through belt (42), pulley (43), pulley (44) and belt (45).

The above-mentioned bottom wall of heating chamber (2) is made of nonmagnetic metal plate so that it is magnetically permeable.

Referring to FIG. 5, a tray (33) and another tray (46) are mounted on the turntable (32) in such a manner that the underside of the upper tray (46) substantially corresponds to the center of the inlet perforations (21) formed in the central area of the partitioning wall (18).

The lower tray (33) is disposed over the turntable (32) with a clearance therebetween, and it is supported by its legs (47), so that the flow of hot air will be blown along the underside of the tray (33). The tray (46) is placed on a shelf (48) which is made of a wire-mesh material and the lowermost end of the leg is a refractory member (49).

Figure 7:
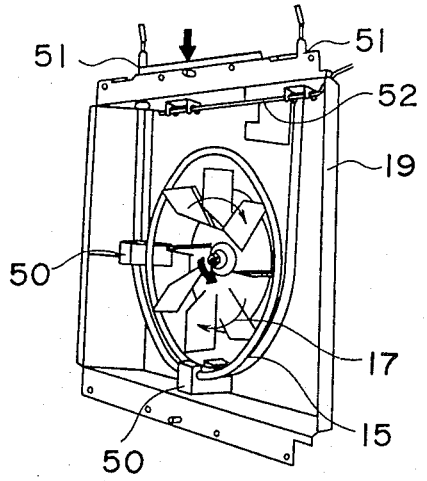
FIG. 7 is a perspective view showing the air circulating fan and associated members of the cooking appliance shown in FIG. 1.

As shown in FIG. 7, the heater (15) is disposed in a helical configuration, with respect to the contour of the fan (17), and is supported by ceramic support members (50, 50) which are angularly displaced 90 degrees from one another, with both terminal ends (51, 51) of the heater (15) being held in position on the top of the deep-drawn plate (19).

Figure 9:
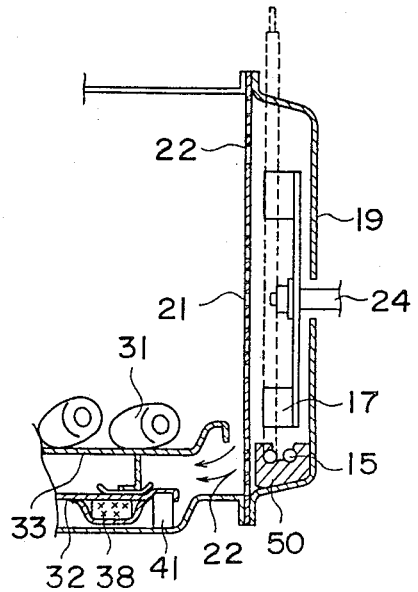
FIG. 9 is a sectional elevational view showing a fan installed in the heating chamber.

As illustrated in FIG. 9, said ceramic support members (50, 50) function as resisters to the air flow generated by the rotation of the fan (17). The air flows in the direction indicated by the arrows and the hot air is blown into the heating chamber (2) at a maximum flow rate through the outlet perforations (22) located nearby. The supporting members (50, 50) are designed to directly support the heater (15) and also serve as resisters to air flow, with the result that a heat exchange with the air takes place here with a high efficiency.

Because of the construction described above, the following advantages can be realized.

Thus, when cooking is performed using the lower tray (33) only, the velocity of air impinging the underside of the tray (33) is high as to ensure a uniform elevation of temperature of the tray (33), while the low velocity of hot air impinging on the food (31) helps prevent drying of the surface of the food (31). As a consequence, the heating mechanism in the appliance functions to heat food by direct heating by hot air flow, by heating the tray, and by heating the atmosphere via by the thermal energy carried with the hot air.

When cooking is performed with an upper tray (46) placed on a shelf (48) superimposed on the lower tray (33), the following effects can be realized. Since the underside of the upper tray is approximately at the same elevation as the center of the inlet perforations (21) as shown in FIG. 5, the inflow of air through the inlet perforations (21) is maximized in the central area. Therefore, the bottom side of the upper tray (46) is heated well while the foods (31, 31) positioned on the upper and lower trays are exposed to an attenuated flow of hot air. Thus, the temperature of the heat-conductive metal trays (33, 46) is substantially uniform and the temperature of the atmosphere surrounding foods is elevated so that the drying of foods is substantially prevented.

Figure 8:
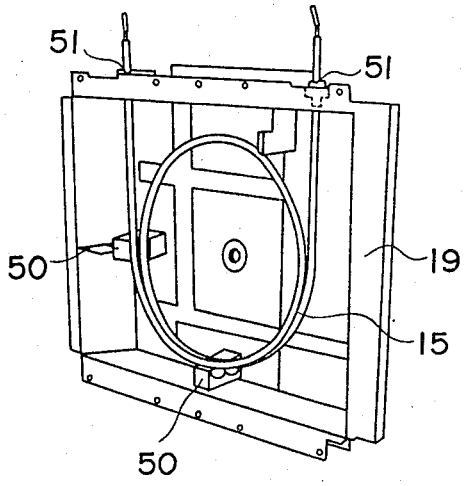
FIG. 8 is a perspective view similar to FIG. 7 but with the fan removed.

Moreover, when, as shown in FIGS. 7 and 8, the heat support members (50, 50) are spaced apart by 90 degrees and one of the support members (50) is disposed in a position corresponding to the center of inlet perforations (21), very satisfactory cooking results can be obtained using both the upper and lower trays (33, 46) concurrently.

In the compartment (20) accommodating the heater (15) and fan (17), there is further disposed a temperature probe (52) which detects the temperature of hot air flow by sensing the hot air temperature within the compartment.

Figure 10:
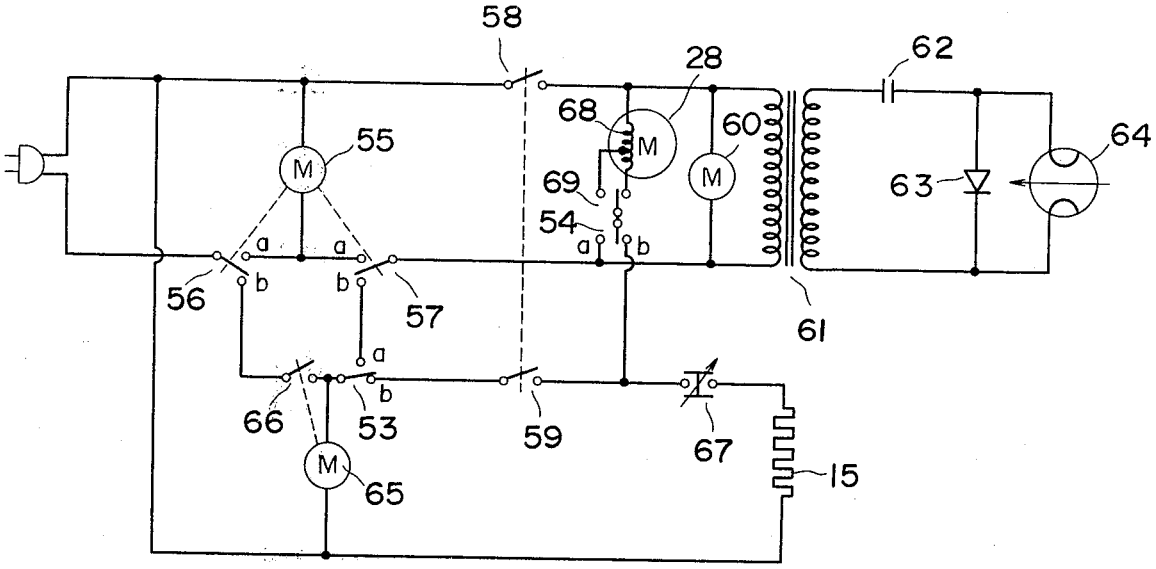
FIG. 10 is an electric circuit diagram for the cooking appliance shown in FIG. 1.

The operation of the cooking appliance according to this invention will hereinafter be described in detail, with particular reference to the electrical circuit of FIG. 10. Referring to FIG. 10, as the select switches (53, 54) are connected to a contacts, the switches (56, 57) connected to a contacts, and operation switches (58, 59) switched on, motors (28) and (60) start rotating to apply a voltage to a high-voltage transformer (61), whereupon the magnetron (64) is energized to oscillation via a capacitor (62) and diode (63) of a voltage doubling circuit on the secondary side of the transformer. In this manner, dielectric heating is accomplished by microwave energy. Then, as the select switches (53, 54) are connected to b contacts, the switches (56, 57) of the timer motor (55) connected to b contacts, the contact point (66) of the timer motor (65) switched on, and the operation switches (58, 59) switched on, the motor (28) for driving the turntable (32) and fan (17) starts rotating and, at the same time, the heater (15) is energized. Therefore, cooking by the hot air circulation described hereinbefore can be accomplished.

It should be understood that a temperature control switch (67) is driven by the temperature probe (52) previously described.

A winding (68) of the motor (28) functions as a terminal intermediate of its length so that the motor winding can be selectably switched from one connection to the other by means of a switch (69).

Thus, when the heating load is a food and the quality thereof tends to be adversely affected when its surface dries, such as confectionary item, the switch (69) may be actuated to switch the motor (28) to a reduced rotational speed and, hence, cooking with a relatively mild velocity of hot air, and when the heating load is a food such that the surface drying thereof does not present a serious problem and a quick browning of its surface is desirable, such as a whole poultry or thigh thereof, the switch (69) may be actuated to increase the number of revolutions per time of the motor (28). Thus, cooking can be performed with an optional hot air flow according to the kind of food to be cooked.

Figure 11:
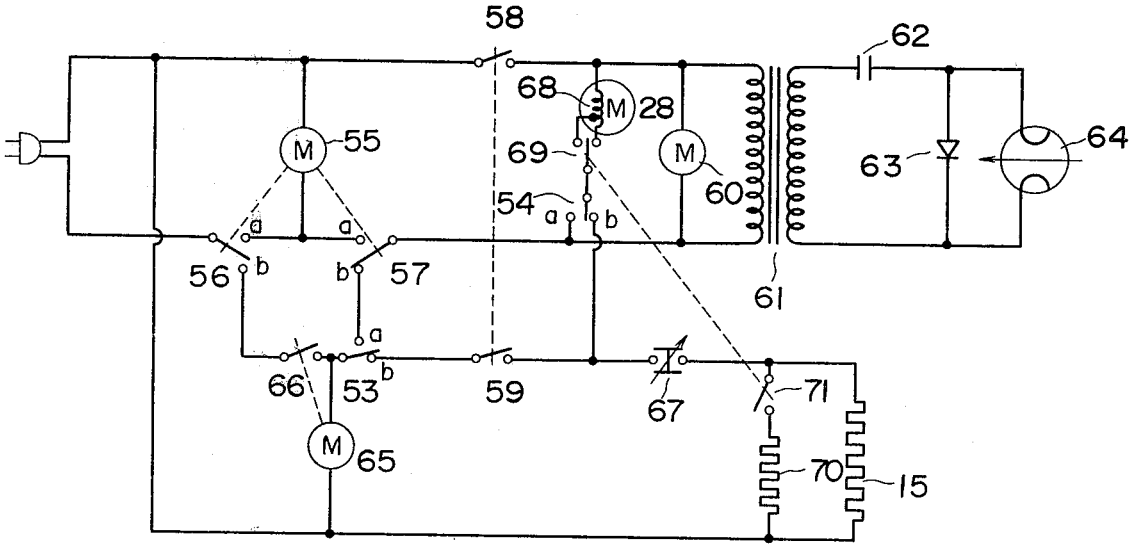
FIG. 11 is an electric circuit diagram for another embodiment of this invention.

Referring, further, to FIG. 11, the appliance may further include an additional heater (70) and a switch (71) which is actuated in response to a switching of the switch (69), and which is a switch for the motor winding (68), for a higher rotational speed of the motor (28). This arrangement ensures a sufficient supply of energy during a higher velocity of hot air so as to effect a substantial shortening of cooking time and a quick browning of the surface of food so that the escape of gravy from the food is minimized. This means that the cooked food will be rich in flavor and nutritive value.

What is claimed is:

1. A cooking appliance employing hot air circulation comprising:
   - an oven body having an oven chamber therein and having a door for opening and closing a passage through a wall of said oven body and which communicates with said chamber;
   - a tray removably mounted on a bottom wall of said chamber for holding food to be heated thereon;
   - said oven body having a compartment positioned adjacent to said chamber;
   - a partitioning wall positioned between said chamber and said compartment and separating said chamber from said compartment;
   - a heater means positioned within said compartment for providing heat energy to said chamber;
   - a fan means positioned within said compartment and operatively associated with said heater means for circulating air heated by said heater means through said chamber;
   - said partitioning wall having at least one inlet perforation through a central area thereof for circulating air from said chamber to said fan means and having at least one outlet perforation through a peripheral area thereof for circulating air from said fan means to said chamber;
   - a first control means for controlling the rotational speed of said fan;
   - a second control means for controlling the amount of heating provided by said heater means; and
   - a third control means operatively associated with said first and second control means for controlling said second control means in response to the rotational speed of said fan.

2. A cooking appliance as claimed in claim 1, wherein said tray is rotatable.

3. A cooking appliance as claimed in claim 1, further comprising a heater supporting and baffling means for supporting said heater means and for baffling air circulated by said fan means.

4. A cooking appliance as claimed in claim 3, wherein said heater supporting and baffling means is at least one ceramic member positioned adjacent said fan means and adjacent said at least one inlet perforation.

5. A cooking appliance as claimed in claim 1 further comprising a second baffling means positioned beneath said tray for baffling air circulated by said fan means along the underside portion of said tray.

6. A cooking appliance employing hot air circulation comprising:

an oven body having an oven chamber therein and having a door for opening and closing a passage through a wall of said oven body and which communicates with said chamber;

a microwave generator for providing microwave energy to said chamber;

a turntable rotatably mounted on a bottom wall of said chamber;

a first tray removably mounted on said turntable for holding food to be heated thereon;

said oven body having a compartment positioned adjacent to said chamber;

a partitioning wall positioned between said chamber and said compartment and separating said chamber from said compartment;

a heater means positioned within said compartment for providing heat energy to said chamber;

a fan means positioned within said compartment and operatively associated with said heater means for circulating air heated by said heater means through said chamber;

said partitioning wall having at least one inlet perforation through a central area thereof for circulating air from said chamber to said fan means and having at least one outlet perforation through a peripheral area thereof for circulating air from said fan means to said chamber; and a first tray supporting and baffling means for supporting said first tray on said turntable and for baffling air circulated by said fan means along the underside portion of said first tray.

7. A cooking appliance as claimed in claim 6, further comprising:

a shelf positioned within said chamber at substantially the same elevation as said at least one inlet perforation; and a second tray removably mounted on said shelf.

8. A cooking appliance as claimed in claim 7, wherein said shelf is made of a wire-mesh.

9. A cooking appliance as claimed in claim 6, further comprising a heater supporting and baffling means for supporting said heater means and for baffling air circulated by said fan means.

10. A cooking appliance as claimed in claim 9, wherein said heater supporting and baffling means is positioned at substantially the same elevation as said at least one inlet perforation.

* * * * *